United States Patent [19]

Dickerson

[11] Patent Number: 4,812,823

[45] Date of Patent: Mar. 14, 1989

[54] LOCKED TRANSMITTER TAG ASSEMBLY AND METHOD OF LOCKABLY ATTACHING SAME TO OBJECT

[75] Inventor: Brian E. Dickerson, Boulder County, Colo.

[73] Assignee: BI Incorporated, Boulder, Colo.

[21] Appl. No.: 37,559

[22] Filed: Apr. 13, 1987

[51] Int. Cl.[4] ..... G08B 13/06

[52] U.S. Cl. ..... 340/572

[58] Field of Search ..... 340/571, 573, 574, 575, 340/576, 572; 24/298; 248/27.3, 231.8, 316.1, 221.4

[56] References Cited

U.S. PATENT DOCUMENTS 4,536,255 8/1985 Holzgang et al. ..... 340/573

4,665,389 5/1987 Clendening ..... 340/574

*Primary Examiner*—Joseph A. Orsino

*Assistant Examiner*—Annie H. Chau

*Attorney, Agent, or Firm*—Bryant R. Gold

[57] ABSTRACT

A sealed, locked housing for an electronic transmitter tag includes a transmitter assembly (20), a battery pack (24), a strap (22), and means for lockably securing the strap and battery pack to the transmitter assembly. The transmitter tag, in a preferred embodiment, is intended for use with a house arrest monitoring system. The transmitter assembly (20) includes a first sealed compartment (54) wherein electronic circuitry (56) is housed. This circuitry transmits signals that uniquely identify the tag and that signal the occurrence of a sensed tamper event. The transmitter assembly also includes a second compartment (25), open to a top side of the assembly, into which the battery pack may be sealably inserted. The means for lockably securing the strap to the transmitter assembly include rails (30, 32) selectively attached to the strap at a desired length. These rails are slidably inserted into open ends of respective keyed channels (31, 33) along each side of the assembly. A locking wedge, comprising a male part (26) and a female part (28), is then slidably inserted and locked into another keyed channel (27) along the top of the assembly, blocking removal of the battery pack and the strap rails. The tag is lockably secured to a desired object, typically an ambulatory object such as a person, by wrapping the strap around a limb of the object, such as a leg, prior to insertion of the strap rails into the receiving channels of the transmitter assembly. Once attached to an object, the transmitter tag cannot be removed without cutting the strap or the locking wedge.

18 Claims, 4 Drawing Sheets

LOCKED TRANSMITTER TAG ASSEMBLY AND METHOD OF LOCKABLY ATTACHING SAME TO OBJECT

BACKGROUND OF THE INVENTION

The present invention relates to means and methods for lockably closing and securing a sealed tag to a desired object. More particularly, the invention relates to a sealed, locked, portable tag assembly wherein electronic circuitry, such as transmitter circuitry used in a monitoring system, can be secured to a desired object and protected from harmful environments.

In U.S. patent application Ser. No. 852,831, filed 04/15/86, which application is assigned to the same Assignee as is the present application, there is disclosed a tag for use with a personnel monitoring system. As indicated therein, a preferred application for such a tag is for use in a house arrest monitoring system wherein individuals who wear the tag can be monitored for compliance with orders or instructions to remain at or report to a prescribed location. As further described in that application, the tag includes electronic circuitry that periodically transmits a unique identifying signal to a remote receiver, which circuitry also includes anti-tamper features for signaling any attempt to remove or otherwise interfere with the proper operation of the tag. U.S. patent application Ser. No. 852,831 is incorporated herein by reference in its entirety.

An important feature of a portable tag used in a personnel monitoring system, as indicated in the referenced application, is that the tag be a self-contained unit that is light-weight, tamper resistant, and can be worn on a limb of the individual being monitored in an unobtrusive manner. Further, the tag must be completely sealed in order to protect the electronic circuits contained therein from exposure to damaging environments. Also, the tag must be made from a substance that is impervious to water and other fluids to which the tag might regularly come in contact, and it should be made from a substance that is comfortable and safe to place against the skin of its wearer.

As described in the above-referenced application, and as shown in FIG. 2 thereof, the tag case is essentially a two-piece molded structure inside of which the electronic circuits and batteries are placed. Once the electronic circuits and batteries are placed inside of the unit, the two pieces of the case are permanently bonded or glued to each other, thereby creating a unitary construction. Such a construction, while offering some advantages, also presents some disadvantages. For example, a unitary construction of this type makes it effectively impossible to service the unit should it malfunction or should the batteries need replacing. Essentially, the case of the unit becomes a throw-away item once the device stops working (either because of malfunction or because of end of battery life), because the case must be literally cut open in order to service the electronic circuits or to replace the batteries.

Further, unless special turn-on circuitry is employed within the electronic circuitry of the tag (which special turn-on circuitry is described in the referenced application), the battery begins to power the electronic circuits from the moment of manufacture when all of the components are sealed into the unitary construction. This is so, even if the tag might be stored on a shelf for many weeks or months before it is actually used, thereby decreasing the effective life of the tag unit. And while special turn-on circuits can be employed, as described in the cited application, such special circuits may add to the complexity and expense of the unit, although in some instances such complexity and expense is justified for other purposes, such as setting up and testing certain tamper conditions after power up.

Additionally, a unitary construction disadvantageously may require the use of separate fastening means, as suggested in FIGS. 2 and 3A of the cited application, in order to fasten the strap ends together at the required length for firmly holding the tag against the flesh of its wearer. Such fastening means not only represent an additional component that increases the cost of the device, but also represent a discontinuity in the strap as it is placed against the skin, and can thereby noticeably interfere with the comfort of wearing the tag. Moreover, such fastening means has one or more exposed screw heads, and the fastening operation must typically take place with the strap and tag in place against body flesh, making the installation quite cumbersome and uncomfortable to the wearer. Further, as also shown in FIG. 2 of the cited application, connecting ears or lobes protruding out from the tag case are used to connect the strap to the tag housing. These ears or lobes may also decrease the comfort of wearing the tag.

In view of the above, it is evident that what is needed is an improved tag assembly that is easier and less expensive to manufacture, service, and install; more efficient to operate; more tamper resistant; and more comfortable to wear. It would also be desirable to provide a tap wherein the battery and strap can be readily replaced in the field without having to replace the entire unit. The present invention addresses these and other needs.

SUMMARY OF THE INVENTION

The present invention provides a tag assembly that is easier and less costly to manufacture, install, and service than has heretofore been available. The tag assembly provided by the present invention is more comfortable to wear, and more difficult to remove than prior tag assemblies.

The present invention includes a transmitter assembly, a battery pack assembly, a strap, and means for lockably securing the strap and battery pack assembly to the transmitter assembly. The transmitter assembly includes a first sealed compartment wherein electronic circuitry is housed. This circuitry transmits signals that uniquely identify the tag and that signal the occurrence of a sensed tamper event. The transmitter assembly also includes a second compartment, open to a top side of the assembly, into which the battery pack assembly may be sealably inserted. Electrical conductors, built into the transmitter assembly and battery pack assembly, allow electrical contact to be made between the batteries within the battery pack assembly inserted into the second compartment and the electrical circuits housed within the first compartment. Advantageously, should the batteries ever need to be replaced, the battery pack assembly can be removed with the use of cutting tool that cuts one of the locking wedges, described below, and a new battery pack assembly can be sealably inserted into the second compartment of the transmitter assembly.

The means for lockably securing the strap to the transmitter assembly include rails selectively attached to the strap at a desired length. These rails are slidably inserted into open ends of respective keyed channels along each side of the assembly. A locking wedge, comprising a male part and a female part, is then slidably inserted and locked into another keyed channel along the top of the assembly, which other keyed channel intersects the keyed channels into which the strap rails are inserted, thereby blocking removal of the strap rails. This locking wedge further serves to prevent removal of the battery pack assembly.

One feature of the invention involves the use of a conductive material for the strap, thereby allowing the anti-tamper electrical circuits within the transmitter assembly to periodically perform electrical continuity checks to verify that the strap has not been cut. Advantageously, in order to realize this feature, the transmitter assembly includes conductive strips built into the rail receiving channels that make and maintain electrical contact with a strap button molded into the rail assembly of the strap. This strap button, in turn, is in electrical contact with the strap. The conductive strips within the receiving channels are also in electrical contact with the anti-tamper circuits within the transmitter assembly. Thus, upon insertion of the rails into their respective receiving channels, the needed electrical connection between the anti-tamper circuits and the conductive strap are automatically made without any special effort or assembly on the part of the installer.

The tag is lockably secured to a desired object, typically an ambulatory object such as a person, by wrapping the strap around a limb of the object, e.g.,a leg, prior to insertion of the strap rails into the rail receiving channels of the transmitter assembly. Advantageously, one of the rails is preferably attached to the strap during manufacture, and the other rail can be easily secured to the strap at the installation site by the installer, thereby allowing the length of the strap to be customized t fit the particular object around which the strap is to be wrapped. Once the rails have been attached to the strap to yield the desired strap length, the strap is then wrapped around the limb of the object, as above-described, and the rails are slid into the respective receiving channels of the transmitter assembly. The male and female parts of the locking wedge are then inserted into opposite ends of the top receiving channel, after the battery pack assembly has been inserted into its chamber, until the male part lockably engages the female part. Once this locked engagement takes place, the transmitter tag is secured and locked to the limb of the object and cannot be removed therefrom without cutting the strap or the locking wedge.

BRIEF DESCRIPTION OF THE DRAWINGS

The above and other advantages and features of the present invention will be more apparent from the following more particular description thereof, presented in conjunction with the following drawings, wherein.

DETAILED DESCRIPTION OF THE INVENTION

The following description presents the best presently contemplated mode of practicing the invention. This description is not to be taken in a limiting sense but is made merely for the purpose of describing the general principles of the invention. The scope of the invention should be ascertained with reference to the appended claims.

As has been indicated, a preferred application for using the present invention relates to a transmitter tag used as part of a house arrest or other personnel monitoring system. See application Ser. No. 852,831, filed 4/15/86, previously incorporated herein by reference. In such a system, the transmitter tag will typically be fastened to the ankle of a person who is to be monitored. See FIG. 3A of the referenced '831 Application. The electronic circuits within the tag perform two main functions: (1) they periodically transmit a unique identification signal that is received and processed by one or more remote receivers, thereby allowing the location of the person wearing the tag to be monitored on a regular basis; and (2) they sense the occurrence of a tamper event, such as an attempt to remove the tag from the ankle of its wearer, and signal the remote receiver of such an occurrence. While the electronic circuits within the tag are important for the proper operation and use of such a personnel monitoring system, it is noted that the present invention is directed primarily to the physical construction of the tag within which such circuits are housed, and the manner in which the tag is fastened to the leg or other limb of the individual being monitored. Accordingly, details of the electronic circuits and their operation are not presented herein. For those interested in such details, reference should be made to the above-identified patent application wherein representative circuit details can be found.

Figure 1:
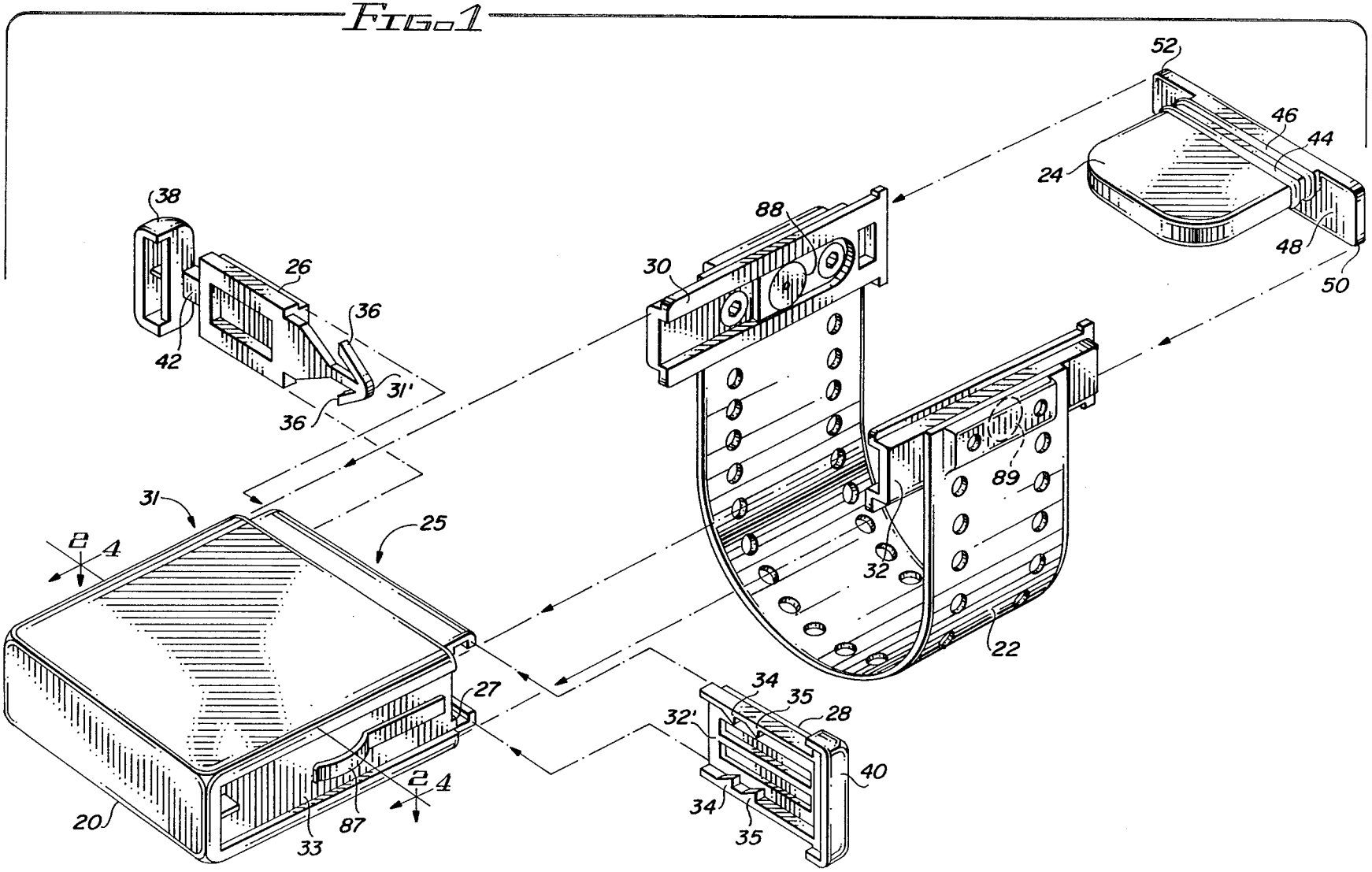
FIG. 1 is a perspective view of the transmitter tag of the present invention showing the main parts thereof in exploded view.

An overview of the present invention will first be presented with reference to FIG. 1, wherein there is shown an exploded view of the principle components of the transmitter tag of the present invention. It is believed that the invention can be fully understood and appreciated by those skilled in the art with reference only to FIG. 1. Nonetheless, in an attempt to further clarify some of the details associated with the use and fabrication of the transmitter tag, and in an attempt to comply with the requirement to describe the preferred embodiment of the invention, the additional details of FIGS. 2–9 are also provided and will be discussed after the overview discussion presented in connection with FIG. 1. It is noted that in all of the figures and description that follows, like parts will be referred to with like numerals throughout.

Referring first then to FIG. 1, an exploded view of the transmitter tag of the present invention is shown. The main components of the transmitter tag include a transmitter assembly 20, a conductive strap 22, a battery pack assembly 24, a male locking wedge 26, and a female locking wedge 28. The electronic circuits of the tag are housed within the transmitter assembly 20. Operating power for these circuits is provided from the battery pack assembly 24, which assembly is slidably inserted into a special compartment 25 (not visible in FIG. 1) of the transmitter assembly 20.

A first rail 30 and a second rail 32 are attached to the ends of the strap 22. Rail 30 is designed to slide into receiving channel 31 (not visible in FIG. 1) along what is the far or back side of the transmitter assembly 20 as the assembly is positioned in FIG. 1. Similarly, rail 32 is designed to slide into receiving channel 33 along the near or front side of the transmitter assembly 20 as such assembly is positioned in FIG. 1. As explained below, the rails are secured to the strap using screws, the heads of which are not accessible for tampering once the rails are installed.

After the rails 30 and 32 have been slid into their respective receiving channels 31 and 33, the battery pack assembly 24 is slid into its receiving chamber 25. O-rings 44 and 46, fitted around the battery pack assembly 24, are used to tightly seal the chamber 25 against the assembly 24, thereby preventing the entry of liquids or other substances into the chamber. A lid portion 48 of the battery pack assembly 24 extends out the entire length of the tag assembly 20. This lid portion 4 forms the bottom of receiving channel 27 once the battery assembly 24 is fully inserted into its receiving chamber 25. Advantageously, the ends 50 and 52 of the lid portion 48 of the battery pack assembly 24 extend out over the strap rail receiving channels 31 and 33, thereby blocking the removal of the strap rails. Thus, in operation, it is impossible to remove the strap rails unless the battery pack assembly is first removed. Of course, removing the battery pack assembly, even for a moment, removes power from the tag's electronic circuits. Such power interruption can be sensed and interpreted as a tamper event. This feature, in combination with the use of a conductive strap (described more fully below), which allows cutting of the strap to be sensed, and the capacitive sensing circuit described in the above-referenced application (which detects if the tag is held in position against body flesh), provide a fail-safe technique for detecting removal or cutting of the strap 22.

Once the battery pack assembly 24 has been inserted into its respective chamber 25 within the transmitter assembly 20, the male locking wedge 26 and the female locking wedge 28 are slidably inserted into opposite ends of an additional receiving channel 27 along what appears as the top or right side of the transmitter assembly 20 as the assembly is positioned in FIG. 1. As the male wedge 26 and the female wedge 28 are slid farther into the channel 27, a tip 31' of the male wedge 26 is received within a channel 32' of the female wedge 28. Sloped engaging ribs or ridges 34 and 35 within the female channel 32' allow the male tip 31' to be inserted into the channel 32' by compressing or squeezing together end portions 36 of the male tip 31' as such end portions 36 slide over the ribs or ridges 34 or 35. These end portions 36 are stiff, but not rigid to the point where they won't bend. However, they are resilient so that if compressed or pushed they return to their normal position. Thus, once the end portions 36 pass over the first set of engaging ribs 34, these end portions cannot pass over the straight back side of the ribs 34, and the male tip 31' is forever thereafter locked within the female channel 32'. Therefore, by slidably inserting the male wedge 26 and the female wedge 28 fully into the channel 27, which full insertion causes the ends 36 of the male tip 31' to pass over both the first set of ridges 34 and the second set of ridges 35 within the female channel 32', the male and female wedges become firmly and securely locked together forever thereafter.

The only way the locking wedges 26 and 28 could thereafter be removed from the channel 27 is by cutting off either the head 38 of the male locking wedge 26 or the head 40 of the female locking wedge. A narrow neck 42 on the male wedge 26 facilitates such cutting, as for example when it becomes necessary to replace the battery pack or remove the transmitter tag from the individual to which it is attached. (It is noted that in a typical house arrest situation, the person wearing the tag will do so voluntarily as an option between being confined to a prison or jail facility or being confined to his own home. Under such conditions, it is not likely that the user will ever attempt to remove or tamper with the tag in any unauthorized fashion for fear of losing the option and thereafter being sent to prison or jail.)

Once the transmitter tag has been assembled, as above-described, with the strap rails 30 and 32 inserted into the receiving channels 31 and 33, and with the battery pack assembly 24 being inserted into its receiving chamber 25, and with the locking wedges 26 and 28 inserted and locked into the channel 27, a sealed, compact unit is realized. In the preferred embodiment, the assembled tag unit is only about 8.6 cm wide by 7.3 cm high by 2.4 cm thick. Further, there are no sharp corners or unsightly protrusions associated with the unit in its assembled form. Rather, the assembled unit provides a small, thin, smooth, closed device that can be comfortably and safely worn by its user.

Figure 2:
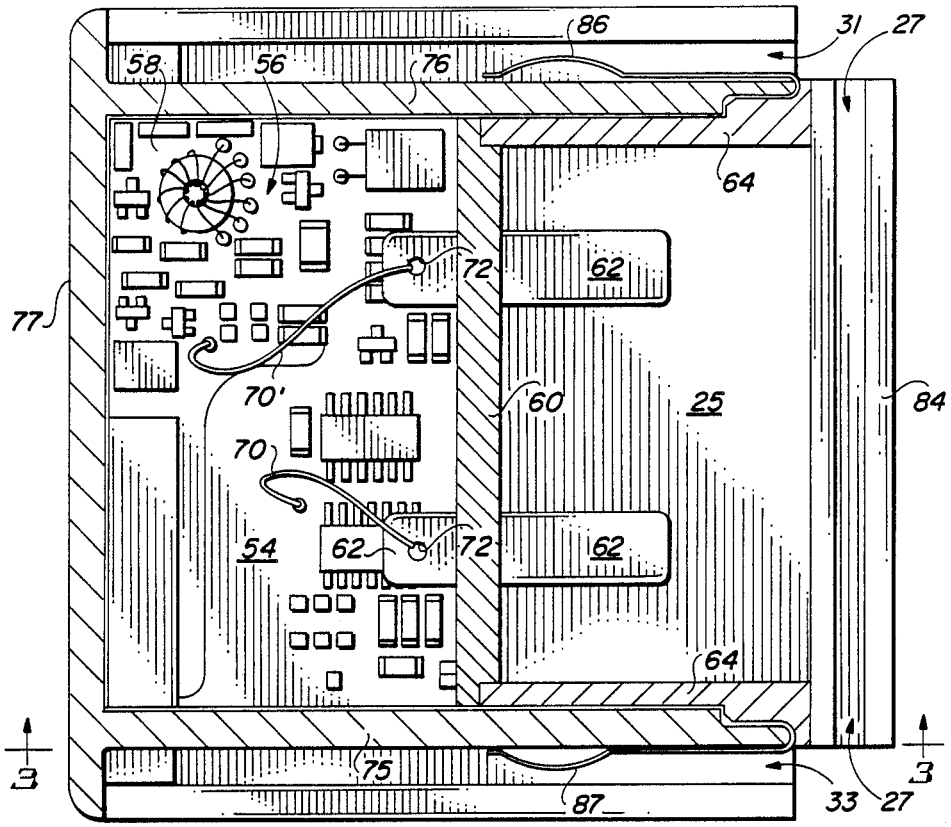
FIG. 2 is a sectional view of the transmitter assembly taken along the line 2—2 of FIG. 1, and shows a present of the electronic components within a preferred arrangement
Figure 3:
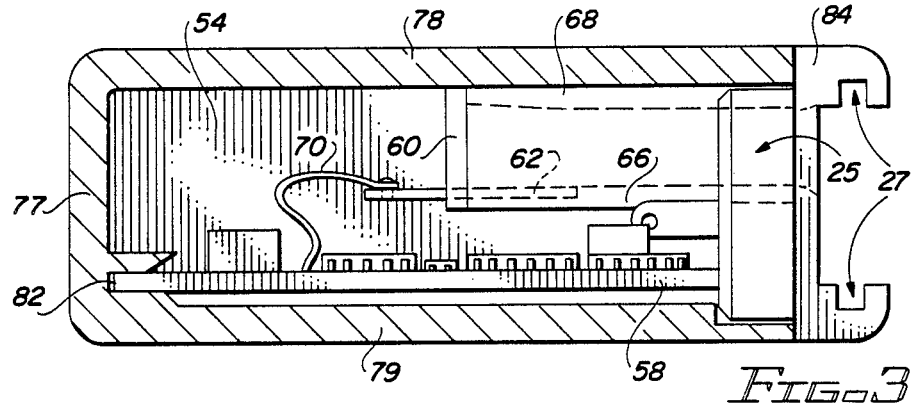
FIG. 3 is a sectional view of the transmitter assembly taken along the line 3—3 of FIG. 2, and shows a profile of the receiving channel along a front edge thereof into which male and female parts of a locking wedge, shown best in FIGS. 1 and 9, are slidably inserted.
Figure 4:
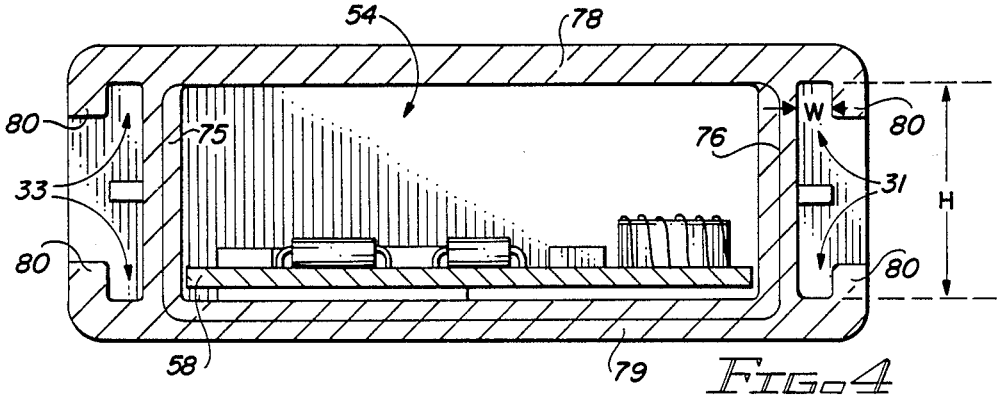
FIG. 4 is a sectional view of the transmitter assembly taken along the line 4—4 of FIG. 1, and includes a profile of the receiving channels on each side of the assembly into which the strap rails, shown best in FIGS. 1, 5A and 5B, are slidably inserted.

Referring next to FIGS. 2–4, some additional details associated with the fabrication of the tag assembly 20 are shown. FIG. 2 is a sectional view taken along the section line 2—2 of FIG. 1. FIG. 3 is a similar view taken along the sectional line 3—3 of FIG. 2. FIG. 4 is a sectional view taken along the line 4—4 of FIG. 1. These three sectional views illustrate how the tag assembly body is divided into two compartments. One compartment 25 is open at one end and is adapted to receive the battery pack assembly 24. Another compartment 54 houses electronic circuitry 56 Such electronic circuitry comprises electrical components, such as integrated circuits, resistors, capacitors, and the like, the outline of some of which are shown in FIGS. 2–4, mounted on a printed circuit board 58.

The battery compartment or chamber 25, as shown best in FIG. 3, occupies only about one quarter of the available space within the tag housing. This compartment is a separate chamber realized by sidewalls 64, a back wall 60, a bottom wall 66, and a top wall 68. A pair of battery terminal plates 62 are placed in the bottom wall 66 and protrude out through the back wall 60 into the compartment 54 housing the electronic circuits. Wires 70 and 70', soldered during assembly to a hole 72 at the back end of each battery plate 62 and to the appropriate circuitry on circuit board 58, allow electrical contact between these battery plates 62 and the electronic circuits.

Figure 5A:
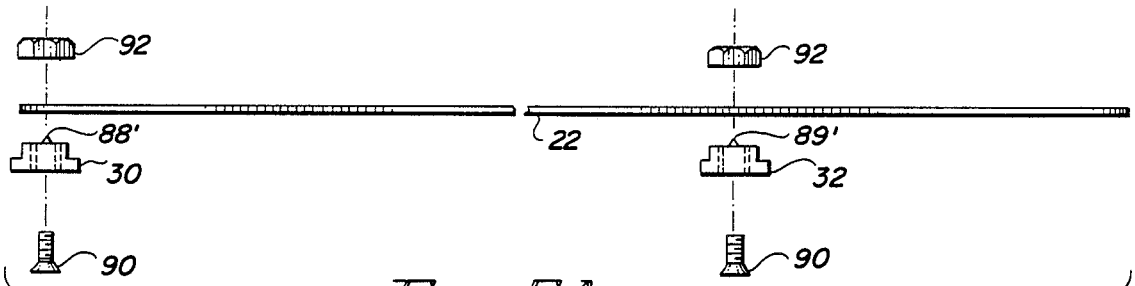
FIGS. 5A and 5B are side and bottom views, respectively, of a strap having rails selectively secured to desired locations along the length thereof, the parts of FIG. 5A being shown in exploded view.

The transmitter assembly shown in FIGS. 2–4 is preferably manufactured as two separate assemblies. A first assembly, sometimes referred to as a base assembly, includes an outer shell that comprises side walls 75 and 76, back wall 77, top wall 78, and bottom wall 79, as well as the receiving channel 31 and the receiving channel 33. This shell is preferably molded from black polystyrene as an integral unit. As shown best in FIG. 4, the side receiving channels 31 and 33, which are included as part of this integral unit, comprise a channel having a width "W" and a height "H" that are open only on one end. A continuous ridge 80 along both the top and bottom sides of this channel prevents a rail, such as the strap rails 30 and 32 (which have cross-sectional dimensions just slightly less than the width W and the height H) from being removed from these channels except through the open end thereof. Further, as shown in FIG. 5A, the strap rails 30 or 32 have a cross-sectional shape that is keyed to fit into the receiving channels 31 or 33 only in one orientation. A support slot 82, for receiving and holding the circuit board 58, is also included as part of the integral base unit assembly.

The second assembly that forms part of the completed transmitter assembly 20 shown in FIGS. 2–4 is a transmitter cover assembly. This cover assembly includes the electronic circuit board 58 (including all of the circuit components mounted thereon), the battery chamber 25 (including the walls 60, 64, 66, 68, the battery contact terminals 62, and the capacitive sensor plates), the strap terminals 86 and 87 molded into the cover, and a front cover 84. The front cover 84 includes the receiving channel 27 adapted to receive the male locking wedge 26 and the female locking wedge 28. This channel 27 is of similar construction to the channels 31 and 33 previously described, except that channel 27 is open on both ends. An opening exists within the upper half of cover 84 in order to allow entry into the battery chamber 25.

During assembly, the cover assembly is slid into the base assembly and firmly bonded thereto using a suitable bonding agent, such as Loctite Prism 410 adhesive, which adhesive is spread evenly around all contacting surface between the two assemblies. Prior to performing this bond, however, strap terminals 86 and 87 are placed within receiving channels 31 and 33, respectively, and electrically connected to appropriate detection circuitry included on the circuit board 58. Preferably, these strap terminals are made from copper strips that are bent so as to extend out into the channels a slight amount. It is the purpose of these strap terminals 86 and 87 to electrically contact strap buttons 88 and 89 located in the strap rails 30 and 32, respectively. As is shown in FIG. 5A, described below, these strap buttons are, in turn, in electrical contact with the conductive strap 22. Thus, the electrical detection circuits are maintained in electrical contact with the strap 22 by wa of the strap terminals 86 and 87 and the strap buttons 88 and 89. Such contact allows the detection circuits to sense if the strap is ever cut.

Figure 5B:
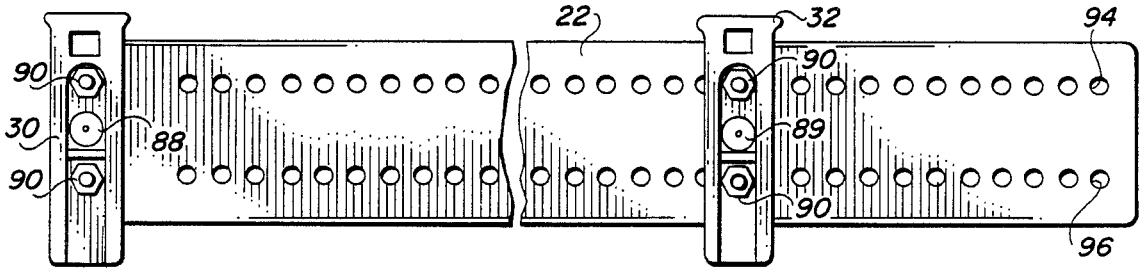

Referring next to FIGS. 5A and 5B, the strap assembly is detailed. This assembly includes a conductive strap 22 to which two end rails 30 and 32 have been fastened. Fastening of the end rails is accomplished by using Allen-head screws 90 that pass through respective holes in the rails 30 or 32 and the strap 22 to a clamp 92. The holes in the clamp 92 are threaded to receive the screws 90. The strap 22 has two rows of holes 94 and 96 predrilled therein every ⅛ inch. These rows of holes allow the rails 0 or 32 to be easily adjusted during installation in order to yield a strap length that is custom fitted to the individual or object to which the tag assembly is attached. However, once the rails are attached to the strap, and the rails are inserted into the channels 31 and 33 of the tag assembly, no further adjustments are possible because the back side of the rails, shown in FIG. 5B, is not accessible, this side being positioned against the inner walls 75 and 76 of the channels 31 and 33. Thus, it is impossible to remove the tag by removing the screws. (However, authorized individuals can replace the straps.) It is noted that once the desired strap length has been selected, by positioning of the rails at the appropriate locations, any excess strap length can be trimmed off, thereby effectively placing the rails at the end of the strap.

Strap contact buttons 88 and 89 are also insert molded the rails 30 and 32. These buttons include point 88' and 89' that is designed to protrude into and make good electrical contact with the conductive strap 22 when the rails 30 or 32 are tightened against the clamps 92 by tightening the screws 90.

In the preferred embodiment, the strap 22 is made from conductive polyethylene, 4.5 cm wide by 0.060 inches thick.

Figure 6A:
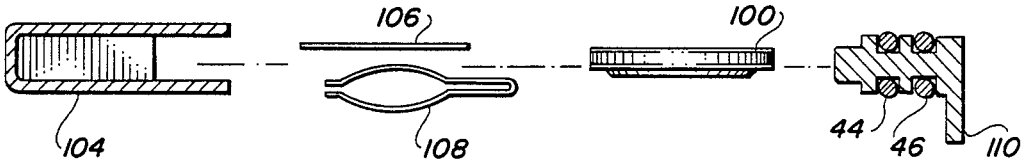
FIGS. 6A nd 6B are side and bottom views, respectively, of the battery pack assembly, the main parts thereof being shown in exploded view.
Figure 6B:
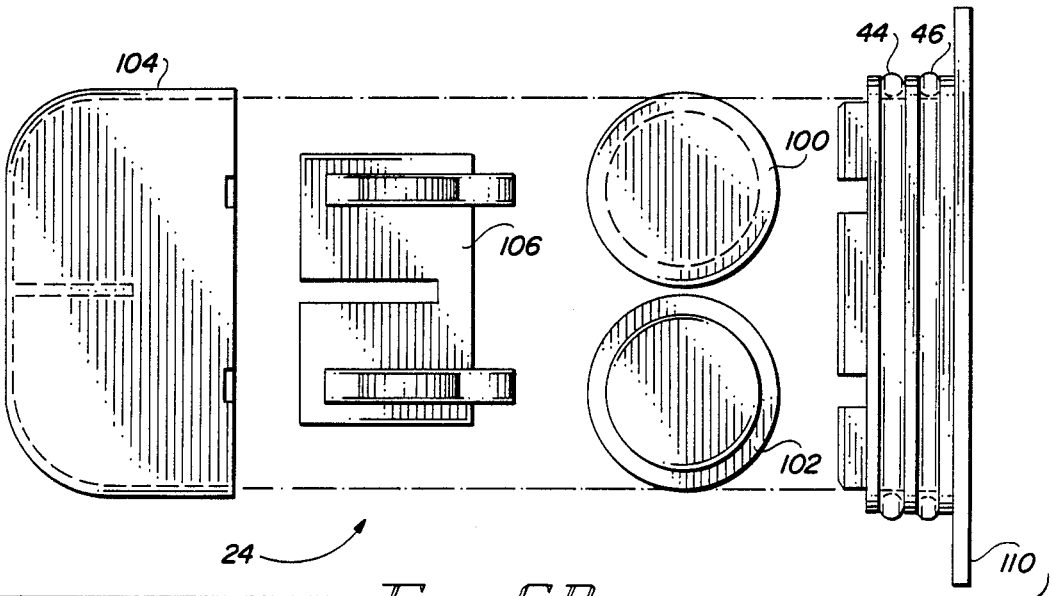

Referring next to FIGS. 6A and 6B, an exploded view of the battery pack assembly 24 is shown. This assembly includes two batteries 100 and 102, a polystyrene base pocket 104, a terminal plate 106, a pair of terminal clips 108, and polystyrene lid assembly 110. The terminal plate 106 allows the two batteries to be connected in series by electrically connecting the positive terminal of one to the negative terminal of the other. The U-shaped terminal clip 108 brings this series battery connection to a point external to the assembly. These clips are positioned to be in alignment with the battery terminals 62 of the battery chamber 25 when the battery pack assembly is inserted thereinto, thereby connecting the series battery connection to the electrical circuits within the closed chamber 54 of the tag assembly.

The pocket 104 is bonded to the lid assembly 110 with a suitable bonding agent, such as Loctite Prism 410 adhesive. After this adhesive has cured, O-rings 44 and 46 ar inserted in appropriate grooves of the lid assembly 110. A suitable O-ring lubricant, such as waterproof grease, is placed on the O-rings prior to insertion of the battery pack assembly 24 into chamber 25.

Figure 7:
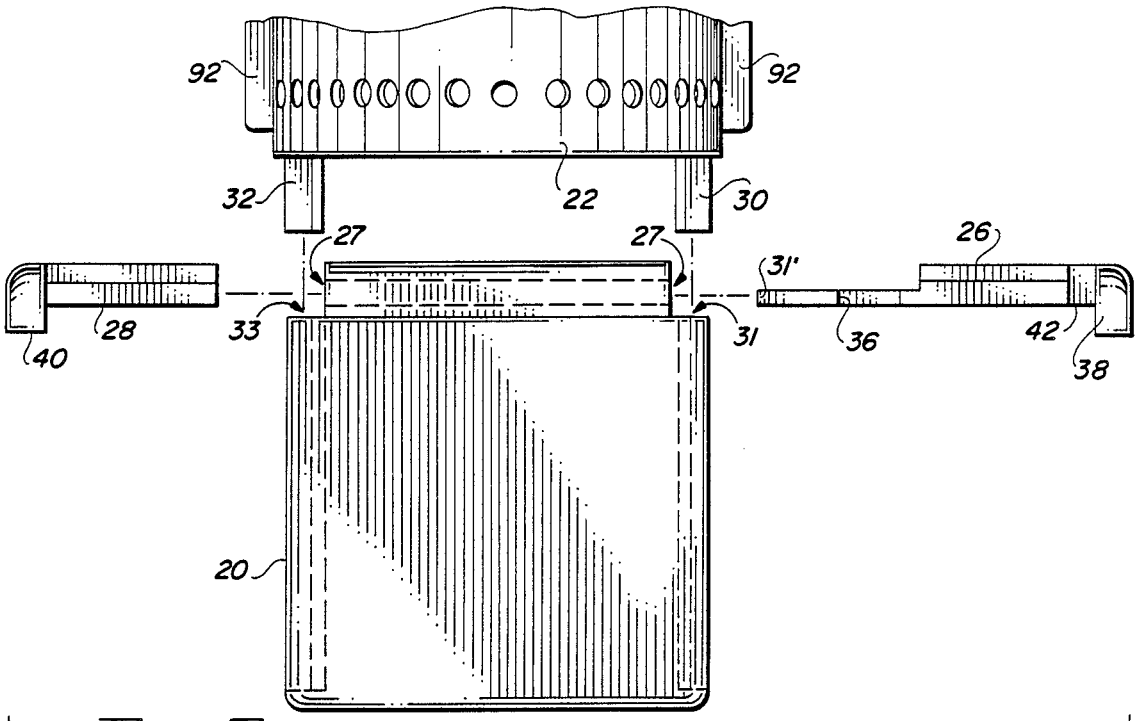
FIG. 7 is an exploded view showing how the rails of the strap are first slid into the side channels of the transmitter assembly, and how a locking wedge is thereafter slid into the top channel of the transmitter assembly after inserting the battery pack (not shown) in order to block removal of the strap rails.
Figure 8:
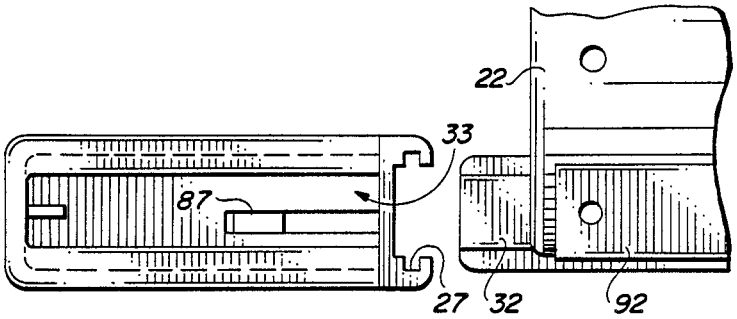
FIG. 8 is a side view of the transmitter assembly, and shows one rail of the strap as it is about to be slid into its receiving channel.
Figure 9:
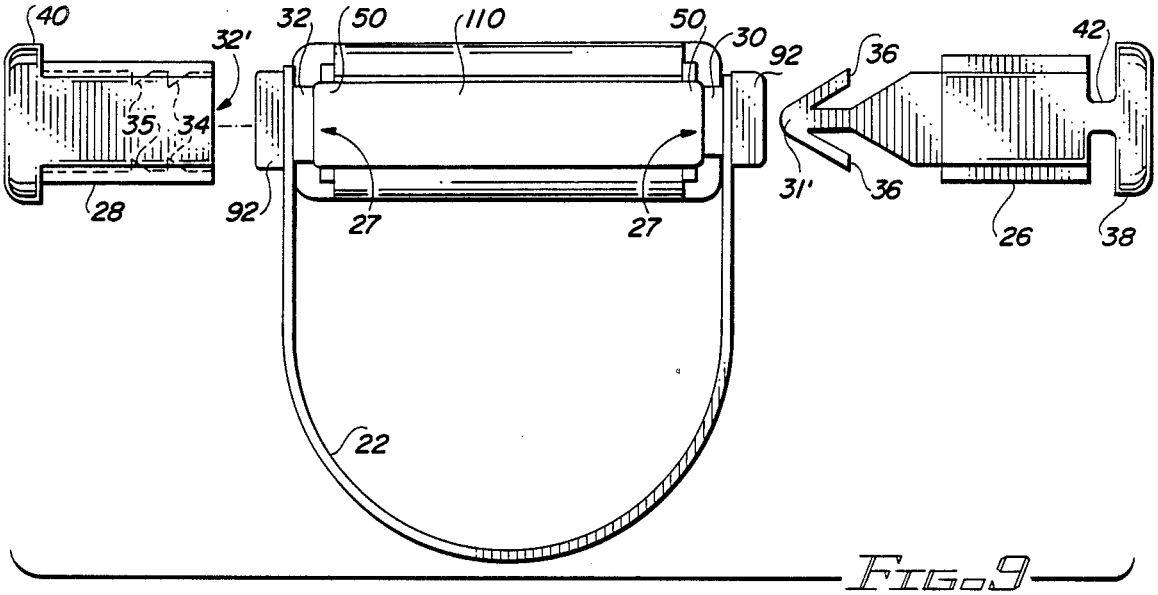
FIG. 9 is a top view of the transmitter assembly with the strap attached thereto, and shows how the male and female parts of the locking wedge are slid thereinto.

Referring next to FIGS. 7–9, additional detail is shown relating to the assembly of the transmitter tag. For example, in FIG. 7, there is shown one particular view of how the strap assembly, including the rails 30 and 32, is slid into the receiving channels 31 and 33; and how thereafter (including after insertion of the battery pack assembly 24, not shown in FIG. 7) the locking wedges 26 and 28 are slid into the receiving channel 27. FIG. 7 highlights that the locking-wedge receiving channel 27 is more or less perpendicular to the rail receiving channels 31 and 33, and that the head portion 40 of the wedge 28 blocks the channel 33, and the head portion 38 of the wedge 26 blocks the channel 31, after these wedges are fully inserted into the channel 27.

FIG. 8 further details the sliding of the rail 32 into the receiving channel 33. A similar view could be drawn for the sliding of the rail 30 into the receiving channel 31 inasmuch as the two rails 30 and 32, and the two channels 31 and 33, are symmetrical.

Finally, FIG. 9 details still another view of the insertion of the male locking wedge 26 and the female locking wedge 28 into both ends of the channel 27. Note in FIG. 9 that the battery pack assembly 24 has been inserted into its chamber 25 within the transmitter assembly as evidenced by the presence of the lid battery pack assembly lid 110. As mentioned previously, the ends 50 of the lid 10 extend over the rails 32 and 30, thereby preventing removal of these rails without first removing the battery pack assembly.

While the invention described herein has been described with reference to a particular embodiment and application thereof, numerous variations and modifications could be made thereto by those skilled in the art without departing from the spirit and scope of the invention as claimed. Accordingly, the true scope of the invention should be determined with reference to the claims set forth below.

What is claimed is:

1. An electronic tag for use with an electronic monitoring system comprising:

a housing having electronic circuitry enclosed therein, said electronic circuitry including means for transmitting a signal to a location remote from said tag; and means for securing and locking said hosing to a limb of an object to be monitored comprising strap receiving means along respective sides of said housing, said receiving means comprising respective receiving channels having an open end, a strap having attachment means at each end thereof for attaching each end of the strap to said receiving means of said housing, said attachment means comprising a rail that can be slidably inserted into said open channels through said open end, said strap having a length that allows it to be wrapped around said limb prior to the attachment of the strap ends to said housing, and locking means for preventing the removal of said attachment means from said receiving means.

2. The tag of claim 1 wherein said locking means comprises:

an additional receiving channel along a top side of said housing;

a blocking wedge that can be slidably inserted into said additional receiving channel, said blocking wedge including means for blocking the open end of said rail receiving channels, whereby the rail cannot be removed from the rail receiving channels after said blocking wedge has been positioned within said additional receiving channel, and means for preventing the removal of said blocking wedge from said additional blocking channel.

3. The tag of claim 2 wherein said blocking wedge comprises a male part for slidable insertion into one end of said additional receiving channel; and a female part for slidable insertion into the other end of said additional receiving channel.

4. The tag of claim 3 wherein said removal preventing means for preventing the removal of said blocking wedge comprises engagement means for locking said male part and female part together within said additional receiving channel upon engaging contact between the male part and the female part.

5. The tag of claim 2 further including a battery assembly that is inserted into said housing through said additional receiving channel, said housing including means for electrically connecting said battery assembly to the electronic circuitry when said battery assembly is fully inserted into said housing, said blocking wedge preventing the removal of said battery assembly when said blocking wedge is slidably inserted into said additional receiving channel.

6. The tag of claim 5 wherein said battery assembly includes sealing means for preventing the entry of fluids into said housing through the same opening through which the battery assembly is inserted into said housing.

7. A locking assembly comprising a base unit having receiving channels along opposite sides thereof;

a strap having respective rails at each end thereof, each of said rails being slidably inserted into a respective one of said receiving channels;

blocking means for blocking the slidable removal of said rails from said receiving channels; and locking means for preventing the removal of said blocking means;

whereby the base unit may be lockably fastened to a desired object by wrapping the strap around a limb of said object prior to inserting said rails into said receiving channels.

8. The locking assembly of claim 7 wherein said blocking means comprises a blocking channel on said base unit that intersects said receiving channels; and a blocking wedge that is slidably inserted into said blocking channel.

9. The locking assembly of claim 8 wherein said locking means comprises means for preventing the removal of said blocking wedge from said blocking channel once said blocking wedge has been inserted thereinto.

10. The locking assembly of claim 9 wherein in said blocking wedge includes a male part and a female part, the male part being slidably inserted into one end of said blocking channel and the female part being slidably inserted into the other end of said blocking channel, and further wherein said means for preventing the removal of the blocking wedge from said blocking channel comprises engagement means for preventing the removal of said male part from said female part when said male part is inserted into said female part within said blocking channel.

11. The locking assembly of claim 7 further including a field replaceable power pack assembly, said base unit including two compartments, a first compartment of which is sealed and houses electronic circuitry, and a second compartment of which is open and receives said power pack assembly, said base unit further including electrical connection means for connecting said power pack assembly inserted into said second compartment to the electronic circuitry housed within said first compartment.

12. The locking assembly of claim 11 wherein said power pack assembly further includes sealing means for sealing said second compartment when said power pack is inserted thereinto.

13. The locking assembly of claim 11 wherein said strap is made from a conductive material, and wherein said rails include first contact means for making electrical contact with said strap, and further wherein said receiving channels contain second contact means for making electrical contact with said first contact means when said rails are inserted into said receiving channels, said second contact means being in electrical contact with said electronic circuitry, said electronic circuitry including detection means for detecting electrical continuity through said strap, whereby said electronic circuitry can sense when said strap is removed or broken.

14. A method of lockably fastening a portable transmitting device to a limb of an ambulatory object with a strap, said strap having rails affixed at each end thereof, said device having receiving channels along the sides thereof adapted to slidably receive said rails, said method comprising the steps of:

(a) wrapping said strap around said limb;

(b) slidably inserting the rails at both ends of said strap into the receiving channels on said device;

(c) physically blocking the removal of said rails from said receiving channels with a blocking element;

(d) locking the blocking element in its blocking position.

15. The method of claim 14 wherein step (c) comprises:

(1) inserting a male portion of said blocking element into one end of a blocking channel, said blocking channel intersecting said receiving channels, said male portion blocking the removal of one of said rails; and (2) inserting a female portion of said blocking element into the other end of said blocking channel, said female portion blocking the removal of the other of said rails.

16. The method of claim 15 wherein step (d) comprises lockably engaging the male portion of the blocking element to the female portion of the blocking element within said blocking channel.

17. A portable tag having electrical circuits therein for use with an electronic monitoring system comprising:

a housing having electronic circuitry enclosed therein, said electronic circuitry including means for transmitting a signal to a location remote from said tag;

a field-replaceable battery pack inserted into said housing, said housing including means for electrically connecting said battery pack to said electronic circuitry when said battery pack is fully inserted thereinto; and means for detachably securing and locking said housing to a limb of an object to be monitored, including means for disconnecting said battery pack from said electronic circuitry whenever said housing is detached from said limb, said means for disconnecting said battery pack comprising means attached to said battery pack for blocking the removal of said strap attachment means from said housing receiving means, before said attachment means can be removed from said receiving means.

18. The portable tag of claim 17 wherein said means for detachably securing and locking said housing to a limb of the object to be monitored comprises strap receiving means along respective sides of said housing, a field-replaceable strap having attachment means at each end thereof for attaching each end of the strap to said receiving means of said housing, said strap having a length that allows it to be wrapped around said limb prior to the attachment of the strap ends to said housing, and locking means for preventing the removal of said attachment means from said receiving means.

* * * * *